US006161301A

United States Patent [19]

Hoshi et al.

[11] Patent Number: 6,161,301

[45] Date of Patent: Dec. 19, 2000

[54] CONTINUOUS DRYING APPARATUS FOR POROUS WEB

[75] Inventors: Younosuke Hoshi; Akira Sanada; Setsuo Suzuki, all of Hiroshima-ken, Japan

[73] Assignee: Mitsubishi Heavy Industries, Ltd., Tokyo, Japan

[21] Appl. No.: 09/265,398

[22] Filed: Mar. 10, 1999

[30] Foreign Application Priority Data

Apr. 10, 1998 [JP] Japan ..... 10-099209

[51] Int. Cl.[7] ..... F26B 11/02

[52] U.S. Cl. ..... 34/111; 34/117; 34/120

[58] Field of Search ..... 34/110, 111, 113, 34/114, 119, 121, 122, 123, 124, 117, 120; 162/202–207, 271, 358.1, 359.1, 363

[56] References Cited

U.S. PATENT DOCUMENTS

| | | | |
|---|---|---|---|
| 3,110,612 | 11/1963 | Gottwald et al. | 117/64 |
| 3,116,985 | 1/1964 | Kraus | 34/110 |
| 3,118,743 | 1/1964 | Malmstrom et al. | 34/110 |
| 4,461,095 | 7/1984 | Lehtinen | 34/41 |
| 4,614,969 | 9/1986 | Gerundt et al. | 358/101 |
| 4,835,880 | 6/1989 | Vecchia | 34/115 |
| 4,949,471 | 8/1990 | Pastor et al. | 34/23 |
| 5,060,396 | 10/1991 | Hansen | 34/16 |
| 5,121,560 | 6/1992 | Daane et al. | 34/13 |
| 5,520,782 | 5/1996 | Schiel | 162/205 |

FOREIGN PATENT DOCUMENTS 1-56198 11/1989 Japan .

OTHER PUBLICATIONS

European Patent Office Communication for European Patent Application No. 99106155.7 including European Search Report dated Apr. 10, 2000.

World Intellectual Property Organization, International application WO 97/15718, May 1997.

*Primary Examiner*—Denise L. Ferensic
*Assistant Examiner*—Andrea M. Joyce
*Attorney, Agent, or Firm*—Armstrong, Westerman, Hattori, McLeland & Naughton

[57] ABSTRACT

A continuous drying apparatus for a porous web including a porous web for traveling on a drying line, a heating cylinder for contacting the porous web at its circumferential surface and rotating in synchronization with the travel of the porous web to heat the porous web, a drying band for contacting and supporting a surface of the porous web which is out of contact with the heating cylinder and also for rotating in synchronization with the travel of the porous web, and a pressure rotating body disposed near the circumference of the heating cylinder and outside the drying band. The pressure rotating body is constructed of a rotating member for rotating and contacting an exterior surface of the drying band and a pressure device for pressurizing the rotating member toward the heating cylinder. With this, a porous web can be efficiently dried.

14 Claims, 7 Drawing Sheets

(1) OSCILLATING PISTON TYPE (2) OSCILLATING PISTON TYPE (3) OSCILLATING PISTON TYPE (4) ROTARY WING TYPE (1) MECHANICAL BOOSTER (2.2kw)
+OIL-SEALED ROTARY VACUUM PUMP (7.5kw)

(2) MECHANICAL BOOSTER (2.2kw)
+OIL-SEALED ROTARY VACUUM PUMP (2.2kw)

(3) MECHANICAL BOOSTER (0.75kw)
+OIL-SEALED ROTARY VACUUM PUMP (2.2kw)

CONTINUOUS DRYING APPARATUS FOR POROUS WEB

BACKGROUND OF THE INVENTION

1. Field of the Invention

The present invention relates to a continuous drying apparatus for a porous web, suitable for use in a pressure drying apparatus applied to the dryer part of a paper machine, a pressure drying apparatus for a porous web other than paper (e.g., a sheet drying apparatus), or the like.

2. Description of the Related Art

FIG. 4 is a schematic diagram showing a conventional continuous drying apparatus for porous web (citation from Japanese Patent Publication No. HEI 1-56198). In this apparatus, as shown in FIG. 4, both a porous web 3 (such as paper, a sheet or the like) to be dried and a drying band (e.g., a drying felt or wire) 4 for supporting this porous web 3 enter an air removing chamber 6 along with an auxiliary wire 5. After being subjected to an air removing process, they are passed through between two surface elements 1 and 8 having satisfactory heat conductivity and air non-permeability.

Here, the above-mentioned surface elements 1 and 8 interpose the porous web 3 therebetween over the entire width. The surface element 1 in contact with the porous web 3 is heated by a heating medium in a heating space 2. Furthermore, the surface element 8 in contact with the drying band 4 is cooled by a liquid flowing through a cooling space 11.

With this, the porous web 3 is heated through the surface element 1, whereby the moisture contained in the porous web 3 vaporizes and turns into steam. On the other hand, since the drying band 4 is cooled through the surface element 8, the steam vaporized from the porous web 3 condenses into water within the drying band 4. In this manner, the water (moisture) contained in the porous web 3 is gradually removed by external heating and cooling, so that the drying of the porous web 3 is continuously performed.

Also, after the drying band 4 is separated from the surface elements 1 and 8, it is separated from the porous web 3 and the condensed water within the drying band 4 is removed at a suction box 17.

Furthermore, the cooling space 11 is sealed through appropriate seals 16*a* and 16*b* with respect to a hood 13 supported by support beams 14 and to rolls 9 and 10. The cooling liquid flowing through this cooling space 11 is supplied from a liquid supply port 12 and exhausted from a liquid exhaust port 15.

However, in such a conventional continuous drying apparatus for porous web, the cooling liquid flowing through the cooling space 11 is sealed by the rolls 9 and 10, so there is a problem in that the cooling liquid will adhere to the surfaces of the rolls 9 and 10 and therefore the surface element 8 will slip on the rolls 9 and 10. Particularly, in the case of running at high speed, this slippage becomes significant, wear on the drying band 4 becomes noticeable, and furthermore, the meandering of the drying band 4 becomes significant, so that stable running is obstructed.

In addition, the space between the hood 13 and various members, which constitute the cooling space 11, is sealed and the support beam 14 is increased in size due to pressure-proof structure, so there is also a problem that substantial time and labor will be required in replacing the surface element 8 or the drying band 4. More specifically, since the surface element 8 and the drying band 4 have an endless structure, they must be slid made to slide and replaced in a direction perpendicular to the paper surface of FIG. 4.

Furthermore, in the continuous drying apparatus for porous web shown in FIG. 4, a closed space is formed upstream of the cooling space 11 serving as a drying section (more specifically, a range from the liquid supply port 12 to the liquid exhaust port 15). An air removing chamber 6 is provided in the closed space. With this, the air 7 in the closed chamber 6 is continuously exhausted with a suction pump, whereby an air removing process is performed. However, in order to increase the drying speed, the pressure within the closed space has to be reduced to about 1 Torr or less. For this reason, there is also a problem in that the exhausting speed of the suction pump will become too high.

The trial example of the required exhausting speed is shown as follows:

(1) Conditions a. Drying Band: Width B×thickness t×void ratio $\Phi$=6 m×0.003 m×0.3 b. Line Speed: u=1200 m/min c. Degree of Vacuum: $P_1$ =1 Torr (2) Calculation of exhausting speed $S=Bt\Phi u\times 760/P=6\times 0.003\times 0.3\times 1200\times 760/1=4.92\times 10^3$ $m^3$/min=$4.92\times 10^6$ liter/min in which S=exhausting speed($m^3$/min or liter/min).

As specifications for the suction pump, an oil-sealed rotary vacuum pump or a mechanical booster pump is selected from the condition of the degree of vacuum. These characteristics are shown in FIGS. 5 and 6, respectively.

As shown in FIGS. 5 and 6, even the conditions at which the required exhausting speeds (liter/min) respectively become maximum (the condition (1) in both FIGS. 5 and 6) are around $1\times 10^4$ 1/min at a degree of vacuum of 1 Torr (pressure $P_1$). In other words, the above-mentioned calculation result ($4.92\times 10^6$ liter/min) is 100 times these general specifications and is therefore far from realistic.

Furthermore, FIG. 7 shows the influence of air (noncondensable gases) on the condensation heat transfer rate of steam. As shown in FIG. 7, as the air content in steam becomes higher, the diffusion movement of steam is blocked. This results in a reduction in the condensation heat transfer rate. A range that can neglect such an influence of air is air content rate<about 0.002 kg (air)/kg (steam). The range is also air content rate<about 0.001 $m^3$ (air)/$m^3$ (steam) in terms of a volume ratio. In other word, partial air pressure is equivalent to 1 Torr or less with respect to the total pressure 1000 Torr of atmospheric pressure.

SUMMARY OF THE INVENTION

The present invention has been made in view of the aforementioned problems. Accordingly, it is an object of the present invention to provide a continuous drying apparatus for porous web which is capable of drying a porous web at higher efficiency.

To achieve this end, the continuous drying apparatus for a porous web according to the present invention is constructed so as to have the following features.

That is, the continuous drying apparatus for porous web according to the present invention comprises a porous web for traveling on a drying line, a heating cylinder for contacting the porous web at its circumferential surface and rotating in synchronization with the travel of the porous web to heat the porous web, a drying band for contacting and supporting a surface of the porous web which is out of contact with the heating cylinder and also for rotating in synchronization with the travel of the porous web, and a pressure rotating body disposed near the circumference of the heating cylinder and outside the drying band. The pressure rotating body is constructed of a rotating member for rotating and contacting an exterior surface of the drying band and pressure means for pressurizing the rotating member toward the heating cylinder.

Therefore, according to the continuous drying apparatus for porous web of the present invention, the drying band contacts and supports the porous web that travels on the drying line, and furthermore, the heating cylinder is pressurized by the pressure rotating body. With this, there is an advantage that the porous web can be efficiently heated to dry the porous web.

Note that a plurality of pressure rotating bodies may be provided according to need. With this, there is an advantage that a degree of contact between the porous web and the heating cylinder is improved to dry the porous web at higher efficiency.

Further, note that in the above-mentioned continuous drying apparatus for porous web, the drying band for contacting and supporting porous web may be constructed of a porous body.

According to such construction, there is an advantage that water evaporated from porous web can be efficiently absorbed.

Furthermore, in the above-mentioned continuous drying apparatus for porous web, a hydraulic unit may be employed as the pressure means.

Moreover, in the above-mentioned continuous drying apparatus for porous web, the drying band may be permeable to air and water, and a cooling surface element impermeable to air and water may be disposed on a surface of the permeable drying band which is out of contact with the porous web.

According to such construction, there is an advantage that the cooling surface element can prevent the entry of external moisture without leaking the absorbed water therefrom.

Additionally, in the above-mentioned continuous drying apparatus for porous web, the permeable drying band and the cooling surface element may be constructed so as to be separable. The permeable drying band may make contact with a surface of the porous web which is out of contact with the heating cylinder, before the porous web makes contact with the heating cylinder. After the porous web makes contact with the heating cylinder, the cooling surface may make contact with the permeable drying band at a predetermined position on the heating cylinder.

Furthermore, an air-eliminating mechanism for eliminating air within both the permeable drying band and the porous web may be provided over the heating cylinder find upstream of the drying line beyond a position at which the porous web makes contact with the cooling surface element.

According to such construction, there is an advantage that the air-eliminating mechanism can absorb air in the porous web without reducing the pressure therein significantly, can also dry the air at higher efficiency, and can considerably reduce dissipation power required of this apparatus.

Moreover, in the above-mentioned continuous drying apparatus for porous web, a cooling unit for cooling the drying band may be provided near the circumference of the heating cylinder and outside the drying band.

According to such construction, the cooling surface element is cooled by the cooling unit, so there is an advantage that water within porous web can be efficiently absorbed.

Note that a plurality of cooling units may be provided according to need. With this, so there is an advantage that cooling power is improved to absorb water within porous web at higher efficiency.

Moreover, in the above-mentioned continuous drying apparatus for porous web, the drying band may be constructed into a loop shape, and a dehydrator for removing water condensed within the drying band may be provided over a path along which the drying band rotates.

According to such construction, the water in porous web, absorbed at the heating cylinder, can be removed with the dehydrator. As a result, there is an advantage that the looped drying band can be continuously used.

Additionally, the above-mentioned continuous drying apparatus for porous web may further comprise a conveyor roll for conveying the cooling surface element. A slippage preventing process may be performed on a surface of the conveyor roll. A groove may be formed in the surface of the conveyor roll as the slippage preventing process.

According to such construction, there is an advantage that even in the case of high-speed running, the cooling surface element can travel without slippage.

Furthermore, in the above-mentioned continuous drying apparatus for porous web, a plurality of heating-medium flow passages may be provided near an interior surface of the heating cylinder.

Moreover, in the above-mentioned continuous drying apparatus for porous web, an induction heating coil may be provided near an exterior surface of the heating cylinder.

DESCRIPTION OF THE PREFERRED EMBODIMENT

An embodiment of the present invention will hereinafter be described in reference to the drawings.

Figure 1:
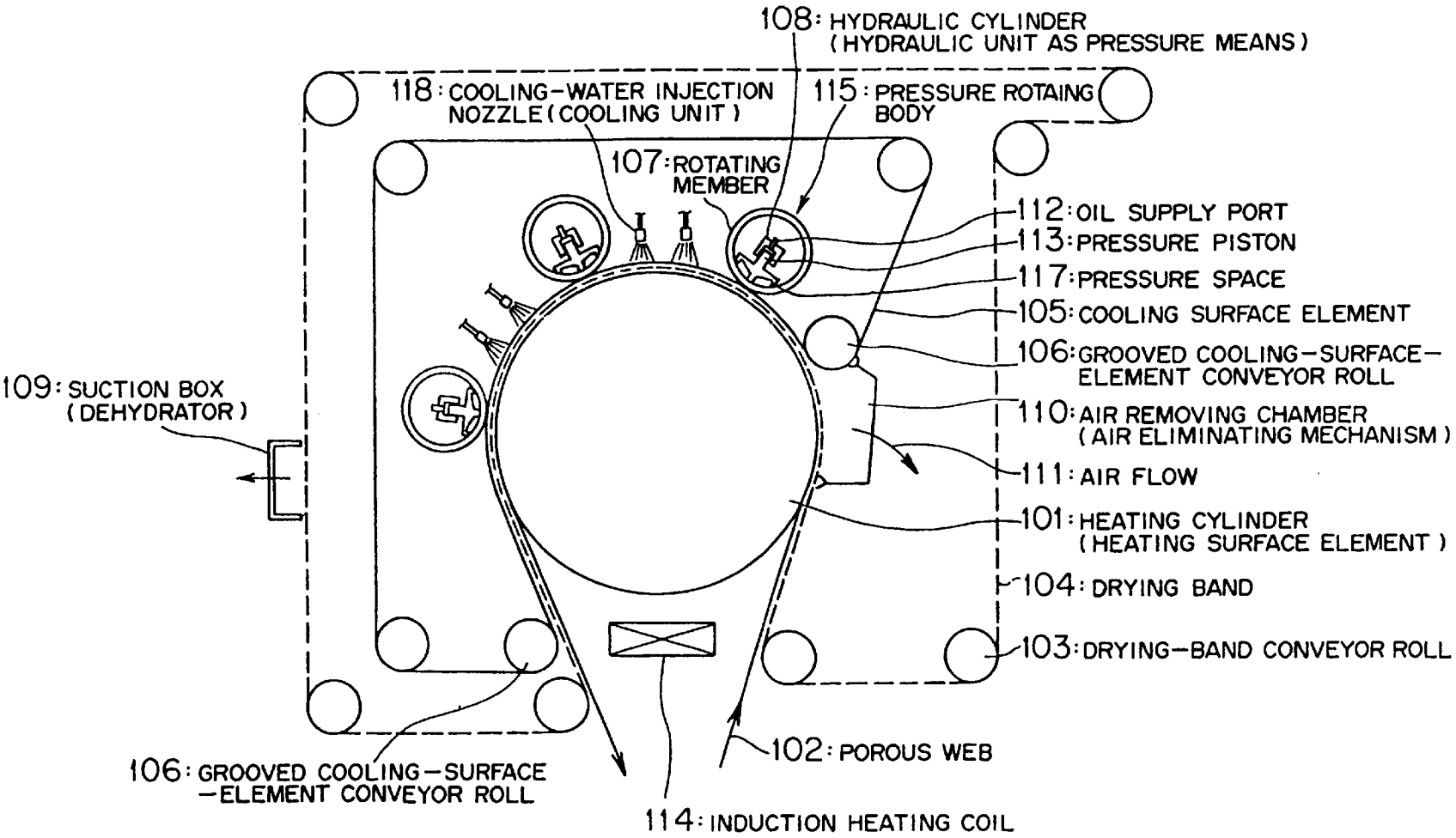
FIG. 1 is a schematic diagram showing the construction of a continues drying apparatus for porous web according to an embodiment of the present invention.
Figure 2:
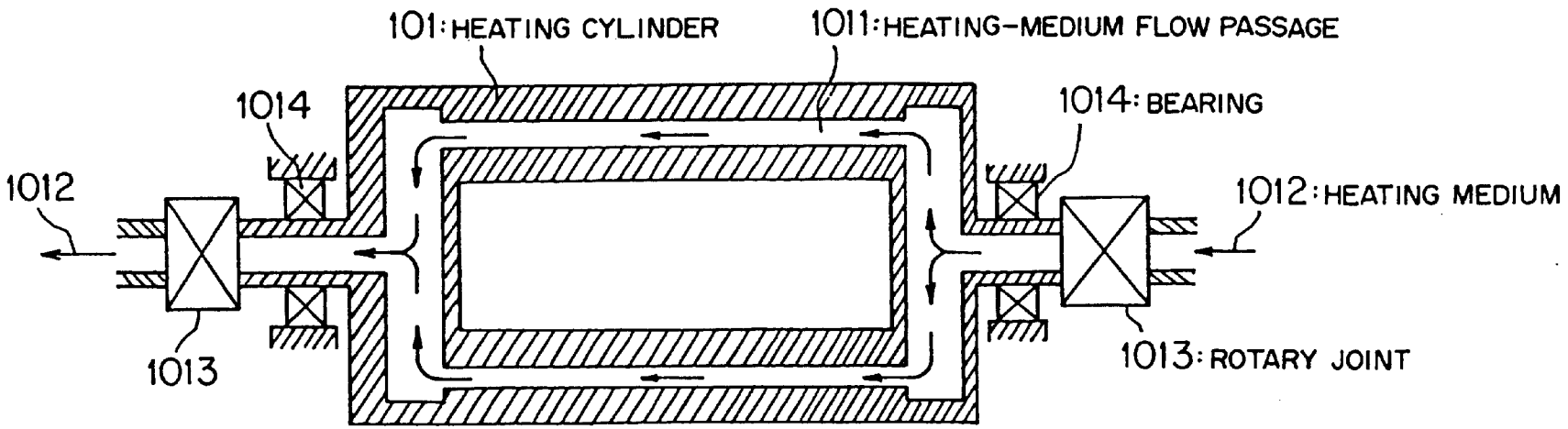
FIG. 2 is a horizontal sectional diagram showing the essential part of the continuos drying apparatus for porous web according to the embodiment of the present invention.
Figure 3:
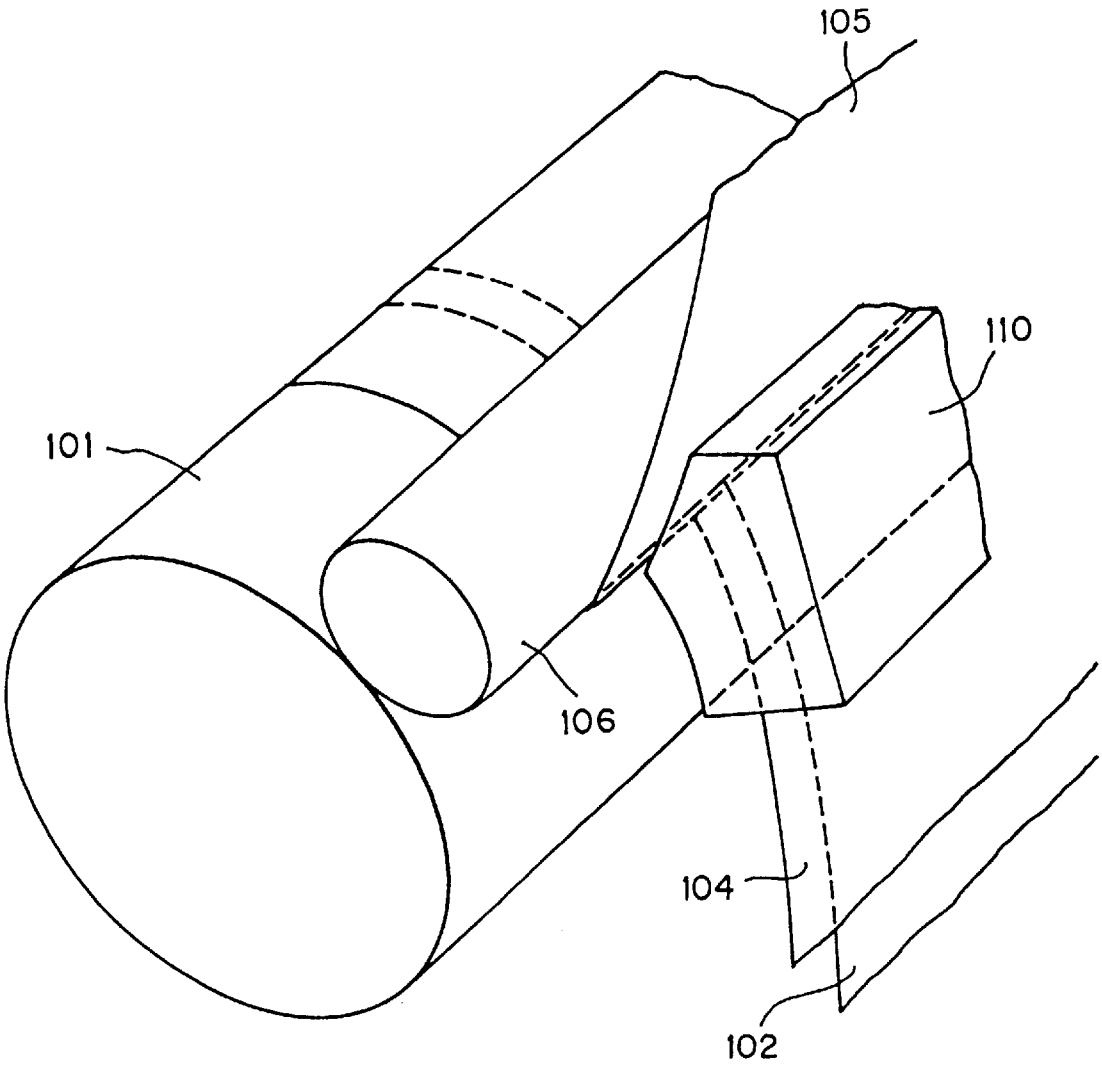
FIG. 3 is a perspective diagram showing the essential part of the continuos drying apparatus for porous web according to the embodiment of the present invention.
Figure 4:
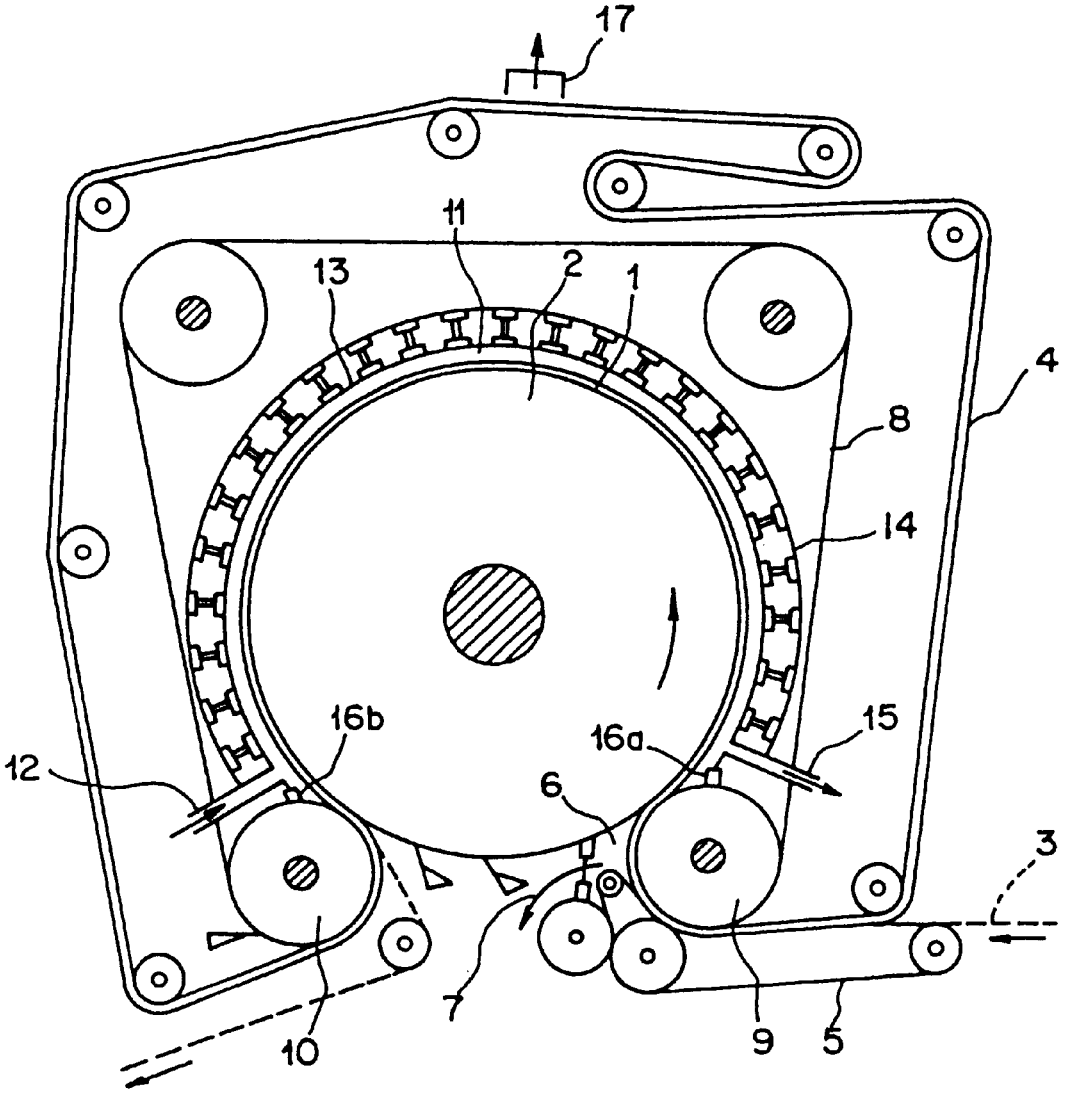
FIG. 4 PRIOR ART
FIG. 4 is a schematic diagram showing the construction of a conventional continuos drying apparatus for porous web.
Figure 5:
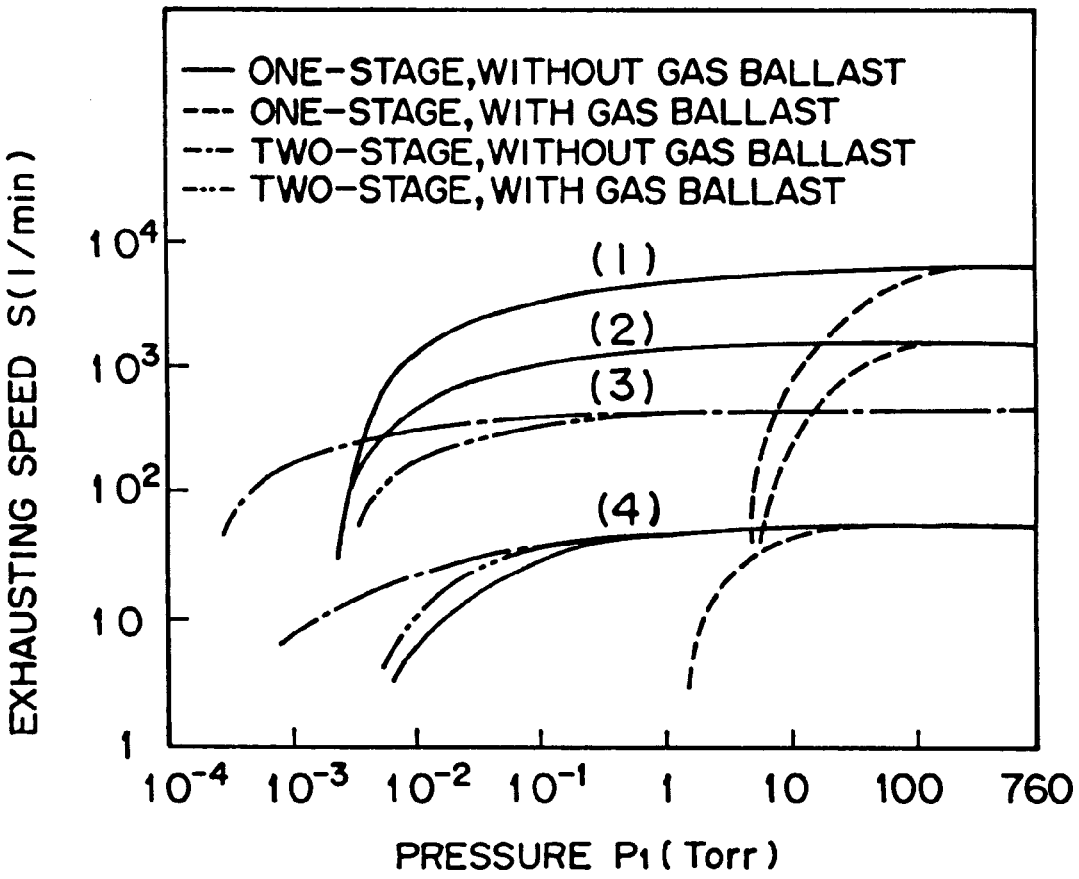
FIG. 5 is a diagram showing the exhaust characteristic of an oil-sealed rotary vacuum pump.
Figure 6:
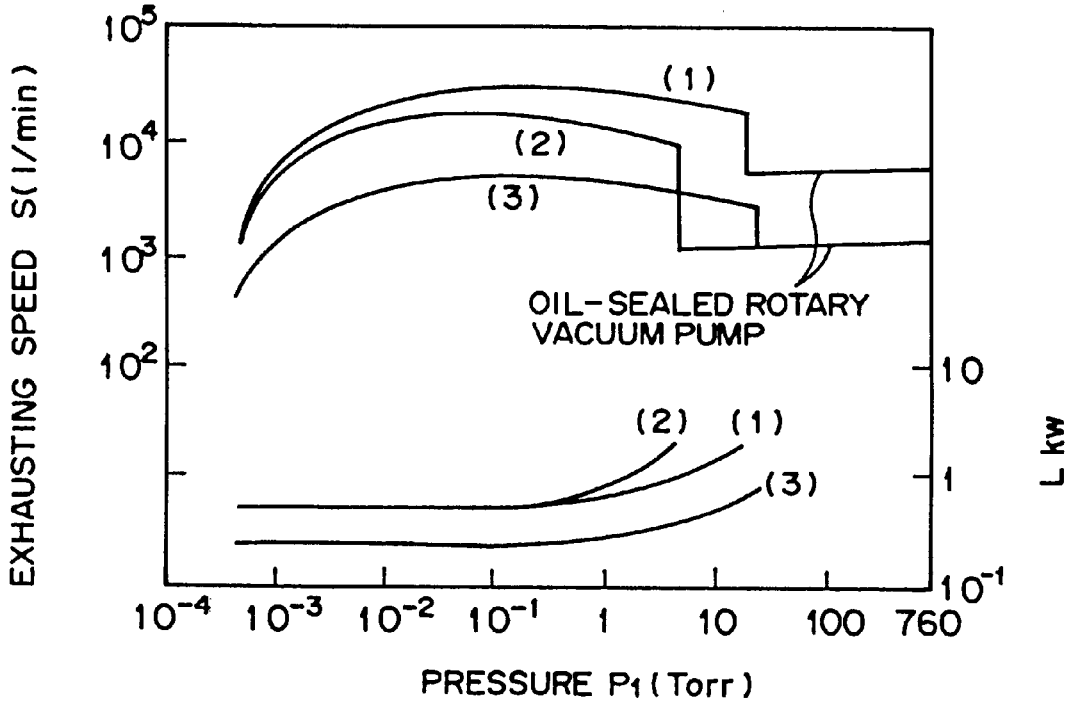
FIG. 6 is a diagram showing the exhaust characteristic of a mechanical booster.
Figure 7:
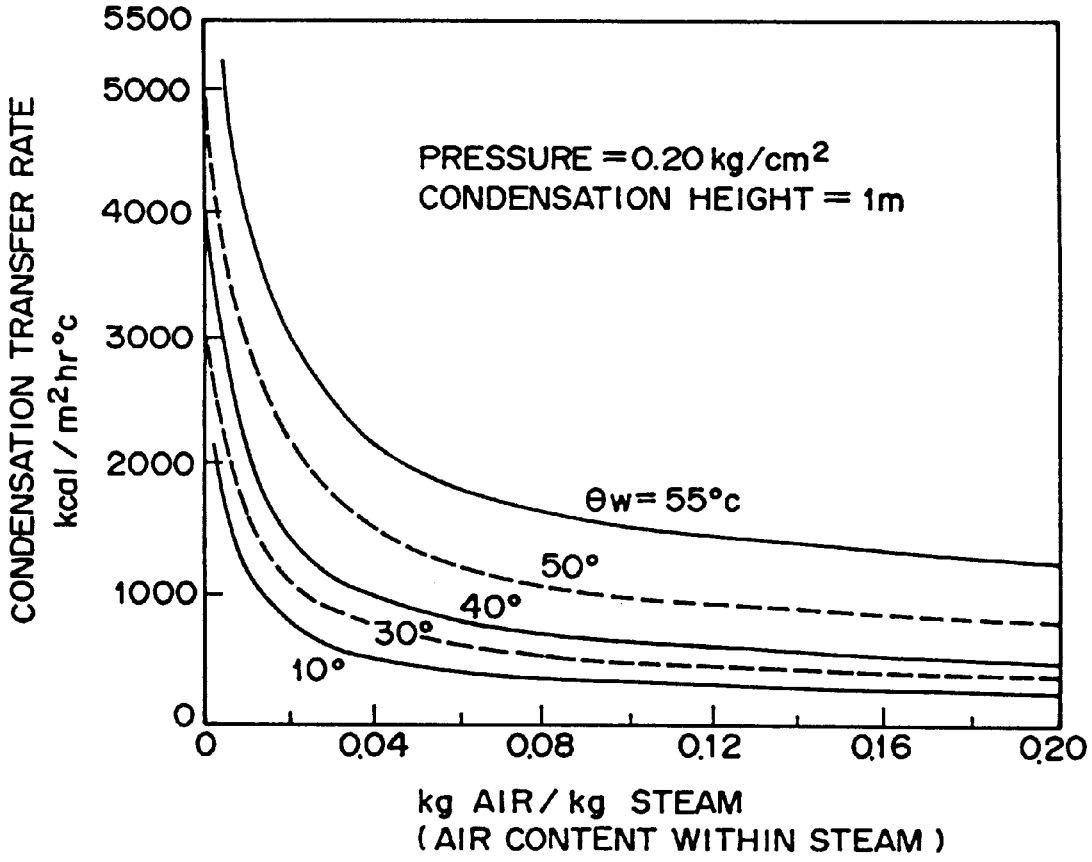
FIG. 7 is a diagram showing the influence of noncondensable gases in steam on condensation heat transfer.

FIGS. 1 through 3 illustrate the construction of a continues drying apparatus for porous web as an embodiment of the present invention. FIG. 1 is a schematic diagram showing the construction, FIG. 2 a horizontal sectional diagram showing the essential part, and FIG. 3 a perspective diagram showing the essential part.

Incidentally, the continuous drying apparatus for porous web according to this embodiment (the concept of this porous web includes paper, hygroscopic sheet and the like), as illustrated in FIG. 1, has a plurality of pressure rotating bodies 115 installed over a heating cylinder (heating surface element) 101 and also has an air removing chamber (air-eliminating chamber) 110 provided upstream of these pressure rotating bodies 115 for removing air in porous web 102 which travels on a conveyor line (also referred to simply as a line) on the heating cylinder 101. A drying band (permeable drying band) 104 permeable to water and air is brought into contact with a surface of the porous web 102 traveling on the line on the heating cylinder 101, the surface being out of contact with the heating cylinder 101. Furthermore, a cooling surface element 105 impermeable to water and air is superposed on the drying band 104 and contacts and supports the drying band 104, thereby drying the porous web 102. A detailed description will hereinafter be made of respective parts and the peripheral constructions.

Here, the heating cylinder 101 contacts at its circumferential surface with the porous web 102, thereby heating the porous web 102. For instance, the heating cylinder 101, as shown in FIG. 2, is provided near the interior surface thereof with a plurality of heating-medium flow passages 1011 and is constructed into a hollow shape. And a heating medium (e.g., Therm S series produced by Shin-nittetu Kagaku Kabushiki Kaisha) 1012, which is supplied and exhausted through rotary joints 1013, is passed through these heat-medium flow passages 1011, whereby the heating cylinder 101 is heated. Note that the heating cylinder 101 is supported by bearings 1014 so that it can rotate.

In addition, while the above-mentioned heating cylinder 101 is heated by the heating medium 1012 in the heating-medium flow passages 1011 formed near the interior surface, an induction heating coil 114 (see FIG. 1) may be installed near the circumference of the heating cylinder 101 to heat the heating cylinder 101. Note that in this case, either the heating medium 1012 or the induction heating coil 114 may be installed for heating, or both of them may be installed to use either one as auxiliary heat. Advantageous methods can be freely selected according to the heating and other conditions.

The drying band (permeable drying band) 104 contacts and supports the surface of the porous web 102 which is out of contact with the heating cylinder 101. The drying band 104 is constructed so as to be permeable to air and water (e.g., it employs porous material), and travels on an endless line that is conveyed by conveyor rolls (drying-band conveyor rolls) 103.

And the drying band 104 absorbs water within the porous web 102 while traveling on this endless line. The absorbed and collected water is removed by a suction box (dehydrator) 109 provided at a predetermined position over the endless belt. This suction box 109 dehydrates water contained in the drying band 104 by a vacuum pump, etc.

Note that the width of this drying band 104 (measurement in a direction perpendicular to the line) is, for example, made wider than that of the porous web 102, as shown in FIG. 3. This is not only because the porous web 102 must be dried uniformly in the width direction thereof but also because the drying band 104, along with the porous web 102, sometimes meander to some degree during travel. Therefore, the width of this drying band 104 is thus made wider than that of the porous web 102 so that the porous web 102 can be reliably dried.

The air removing chamber 110 is installed ahead of the position at which the porous web 102 makes contact with the cooling surface element 105, i.e., in a region (closed space) to which the drying band 104 on the heating cylinder 101 is exposed.

This air removing chamber 110 eliminates air contained within both the drying band 104 and the porous web 102. More specifically, both the steam that is evaporated when the porous web 102 contacts with and is heated by the heating cylinder 101 and the air within the porous web 102 are absorbed by a suction pump (not shown) provided in this air removing chamber 110.

In other words, by heating the porous web 102 with the heating cylinder 101, water contained in the porous web 102 evaporates and turns into steam. With this steam, air within the porous web 102 is expelled from the porous web 102 as shown by an arrow (air flow) 111, and the partial air pressure within the porous web 102 is reduced. As a result, it becomes possible to remove air within the porous web 102 without reducing the pressure in the air removing chamber 110 considerably (e.g., to about 1 Torr) as in the prior art. More specifically, it will be sufficient if the pressure is reduced to about 660 Torr. Therefore, high drying performance can be obtained.

Note that since the pressure within this air removing chamber 110 equals the pressure within the suction box 109 positioned over the drying band 104, a water sealed pump, for example, is employed as the suction pump to suck air.

In addition, the air removing chamber 110, as depicted in FIG. 3, is installed so as to have a narrower width than the width (measurement in the direction perpendicular to the line) of the cooling surface element 105 that travels on the line. With this, water for cooling the cooling surface element 105, injected by cooling-water injection nozzles (cooling units) 118 to be described later, is prevented from entering this air removing chamber 110.

The cooling surface element 105 contacts and supports the surface of the porous web 102 which is out of contact with the heating cylinder 101. The cooling surface element 105 is constructed so as to be impermeable to air and water and is traveled on the endless line by grooved conveyor rolls (grooved cooling-surface-element conveyor rolls) 106. And the cooling surface element 105 cools the porous web 102 being fed, while traveling on this endless line. Note that the grooved conveyor rolls 106 will be described later.

More specifically, before the porous web 102 makes contact with the heating cylinder 101, the drying band 104 is brought into contact with the surface of the porous web 102 which is out of contact with the heating cylinder 101. After the porous web 102 comes into contact with the heating cylinder 101, this cooling surface element 105 is brought into contact at a predetermined position on the heating cylinder 101 (downstream side of the air removing chamber 110) with the surface of the drying band 104 which is out of contact with the porous web 102.

Hence, the cooling effect of this cooling surface element 105 will hereinafter be described. In order to effectively push the porous web 102 which is dried against the heating cylinder 101, there is a need to process steam evaporated within the closed space enclosed by the heating cylinder 1 and the cooling surface element 105. If the porous web 102 is not cooled by this cooling surface element 105, then the pressure within this closed space will be raised by the pressure of steam evaporated from the porous web 102 and will exceed the pressure with which the cooling surface element 105 presses the porous web 102 against the heating cylinder 101. Also, if the pressure of steam within this closed space reaches saturation vapor pressure, water within the porous web 102 will no longer evaporate. In other words, in order to prevent this, a particular cooling surface such as the cooling surface element 105 is made, whereby steam within the porous web 102 is condensed and removed.

Also, the plurality of pressure rotating bodies 115 are disposed near the circumference of the heating cylinder 101 at predetermined intervals from the outside of the cooling surface element 105. As shown in FIG. 1, the pressure rotating body 115 is constructed of a rotating member 107 for contacting and pressurizing the exterior surface of the cooling surface element 105, and a hydraulic cylinder (hydraulic unit as pressure means) 108 for pressurizing this rotating member 107 toward the heating cylinder 101 through a film of oil.

More specifically, the hydraulic cylinder 108 is provided with a pressure piston 113 that applies pressure to the rotating member 107. The pressure piston 113 is pushed by the pressure of oil supplied from an oil supply port 112 provided in the hydraulic cylinder 108, so that the rotating member 107 is pressurized. In other words, the cooling surface element 105 can be pressurized with arbitrary pressure developed by the hydraulic cylinder 108.

At this time, part of the oil supplied from the oil supply port 112 is also supplied to the pressure space 117 between the rotating member 107 and the pressure piston 113, and a film of oil is formed within the pressure space 117. For this reason, the pressure piston 113 pressurizes the rotating member 107 toward the heating cylinder 101 through a film of oil within the pressure space 117 instead of directly pressurizing the rotating member 107. With this, the rotating member 107 is free to rotate although being pressurized by the pressure piston 113. As a consequence, the rotating member 107 is prevented from resisting the traveling of the cooling surface element 105 when contacting and pushing the cooling surface element 105.

Note that the pressure rotating body 115 is equipped with drive means (e.g., a hydraulic unit, a motor, etc.(not shown)). With this drive means, the pressure rotating body 115 is movable toward and away from the heating cylinder 101 in the radial direction of the heating cylinder 101. With this, the exchange of the cooling surface element 105 or the drying band 104 can be readily performed by moving the pressure rotating body 115 away from the heating cylinder 101 in the radial direction.

In addition, a plurality of cooling-water injection nozzles (cooling units) 118 are disposed near the circumference of the heating cylinder 101 along with the pressure rotating bodies 115. These cooling-water injection nozzles 118 are used to inject cooling water for cooling the cooling surface element 105. Between the pressure rotating bodies 115, the cooling-water injection nozzles 118 are disposed at appropriate intervals so that the entire cooling surface element 105 can be uniformly cooled. Furthermore, the cooling water that is injected from the cooling-water injection nozzle 118 is used not only for cooling the cooling surface element 105 but also for reducing the friction between the rotating member 107 and the cooling surface element 105. Note that this cooling water is collected and recirculated.

The cooling surface element 105, incidentally, is conveyed by the grooved conveyor rolls 106, as described above. The groove (not shown) formed in the surface of this grooved conveyor roll 106 is provided for a slippage preventing process.

More specifically, the groove is formed in the surface of the roll, so water injected from the cooling-water injection nozzle 118 can enter this groove. And the water that entered this groove is flung away by centrifugal force, or adheres to the cooling surface element 105 and is exhausted. Note that the groove in the roll surface can be formed in various forms. For instance, the groove can extend in the direction along the circumferential surface of the roll or in the direction crossing this direction.

With such a groove, water can be held in the groove in the roll surface at the portion where the grooved conveyor roll 106 and the cooling surface element 105 contact each other, and between the surface of the roll other than the groove and the cooling surface element 105, they can directly contact each other without a film of water. Therefore, even in the case of high-speed running, the cooling surface element 105 can stably travel without slipping on the grooved conveyor rolls 106.

Note that while the aforementioned embodiment has been described in detail with reference to the grooved conveyor roll 106 provided in the roll surface thereof with a groove, the roll surface is not limited to a groove such as this, but may be simply roughened. Even in this case, water can be easily exhausted. Furthermore, not only does the exhaust of water become easy by forming a groove or roughening a surface, but the friction of the roll surface relative to the cooling surface element 105 can also be made great. As a result, the effect of slippage prevention can be further enhanced.

With the above-mentioned construction, in the continuous drying apparatus for porous web according to an embodiment, as shown in FIG. 1, before the porous web 102 that is dried makes contact with the heating cylinder 101, the surface of the porous web 102 which is out of contact with the heating cylinder 101 is contacted by the drying band 104. After the porous web 102 in contact with this drying band 104 comes into contact with the heating cylinder 101, it is heated by the heating cylinder 101.

Thereafter, the porous web 102 is heated, so that the water within the porous web 102 evaporates with steam pressure greater than atmospheric pressure. At this time, air is expelled out of the porous web 102. Then, air (air within the drying band 104, steam within the air removing chamber 102, etc.) is sucked by the air removing chamber 110.

Subsequently, the surface of the drying band 104 which is out of contact with the porous web 102 is contacted at the heating cylinder 101 downstream of the air removing chamber 110 by the cooling surface element 105. In this state, the porous web 102 from which the interior air has been sucked by the air removing chamber 110 is conveyed on the heating cylinder 101.

At this time, water within the porous web 102 evaporates and turns into steam by the heating of the heating cylinder 101. That is, the water is reiteratedly subjected to the pressure of the pressure rotating bodies 115 and the cooling of the cooling water from the cooling-water injection nozzle 118, so that the water is condensed within the drying band 104 and is adsorbed and conveyed by the drying band 104. Note that this adsorbed water is removed by the suction box 109 over the conveyor line of the drying band 104.

In this manner, according to the continuous drying apparatus for porous web as an embodiment of the present invention, the porous web 102 traveling on the conveyor line on the heating cylinder 101 is pressed against the heating cylinder 101 by the plurality of pressure rotating bodies 115. As a result, the cooling surface element 105 is effectively pressed under arbitrary pressure, whereby the porous web 102 can be dried. Furthermore, since the pressure rotating body 115 is movable toward and away from the heating cylinder 101, there is an advantage that exchange of the drying band 104 and the cooling surface element 105 can be readily performed.

Also, since the drying band 104 that contacts and supports the porous web 102 consists of a porous body, there is an advantage that the drying band 104 can efficiently absorb water evaporated from the porous web 102.

In addition, because the cooling surface element 105 is disposed on the surface of the drying band 104 which is out of contact with the porous web 102, there is an advantage that the cooling surface element 105 can prevent the entry of external moisture without leaking the absorbed water therefrom.

Furthermore, the air removing chamber 110 is provided over the heating cylinder 101 in front of the position at which the cooling surface element 105 is brought into contact with the drying band 4 and also heats the porous web 102 which is in contact with the drying band 104, so there is an advantage that the air removing chamber 110 can absorb air in the porous web 102 without reducing the pressure therein significantly, can also dry the air at higher efficiency, and can considerably reduce dissipation power required of this apparatus.

Moreover, since the cooling surface element 105 is cooled by the cooling water from the cooling-water injection nozzle 118, there is an advantage that the drying band 104 can efficiently absorb water within the porous web 102.

Additionally, the drying band 104 travels between the heating cylinder 101 and the suction box 109 so that the water in porous web 101, absorbed at the heating cylinder 101, can be removed with the suction box 109. As a result, there is an advantage that the looped drying band 104 can be continuously used.

Finally, as a groove is provided in the surface of the conveyor roll 106 that conveys the cooling surface element 105, water injected from the cooling-water injection nozzle 118 can be easily exhausted. In even in the case of high-speed running, there is also an advantage that the cooling surface element 105 can travel stably without slippage.

Note that the present invention is not limited to the above-mentioned embodiment. Many widely different embodiments of the present invention may be modified without departing from the scope of the invention. For example, in this embodiment, although the cooling-water injection nozzle 118 is provided as a cooling unit for performing cooling by cooling water, the invention is not limited to this. For instance, the cooling surface element 105 may be cooled by other cooling media such as cooling air and the like.

What is claimed is:

1. An apparatus for continuously drying a porous web traveling along a drying line, comprising:

a heating cylinder for supporting the porous web on its circumferential surface, said heating cylinder being rotatable in synchronization with the travel of the porous web for heating said porous web;

a drying band wound around said heating cylinder for sandwiching the porous web with said heating cylinder, said driving band being rotatable in synchronization with the travel of the porous web;

at least one pressure rotating body disposed radially outward near the circumference of said heating cylinder and said drying band; and air eliminating means formed of an air eliminating mechanism and an air removing chamber for eliminating air within said drying band and the porous web, said air removing chamber being provided over said heating cylinder and said drying band, wherein said at least one pressure rotating body includes a rotating member for rotating in contact with an outer surface of said drying band, and means for pressing said rotating member against said heating cylinder to assist said drying band in bringing the porous web into close contact with the circumferential surface of said heating cylinder.

2. The continuous drying apparatus for a porous web as set forth in claim 1, wherein said drying band consists of a porous body.

3. The continuous drying apparatus for a porous web as set forth in claim 1, wherein a hydraulic unit is employed as said means for pressure.

4. The continuous drying apparatus for a porous web as set forth in claim 1, wherein said drying band is permeable to air and water; and a cooling surface element impermeable to air and water is disposed on a surface of said permeable drying band which is out of contact with said porous web.

5. The continuous drying apparatus for a porous web as set forth in claim 4, wherein said permeable drying band and said cooling surface element are constructed so as to be separable;

said permeable drying band makes contact with a surface of said porous web which is out of contact with said heating cylinder, before said porous web makes contact with said heating cylinder; and after said porous web makes contact with said heating cylinder, said cooling surface element makes contact with said permeable drying band at a predetermined position on said heating cylinder.

6. The continuous drying apparatus for a porous web as set forth in claim 5, wherein said air-eliminating means is provided over said heating cylinder and upstream of said drying line beyond a position at which said porous web makes contact with said cooling surface element.

7. The continuous drying apparatus for a porous web as set forth in claim 1, wherein a cooling unit for cooling said drying band is provided near the circumference of said heating cylinder and outside said drying band.

8. The continuous drying apparatus for a porous web as set forth in claim 1, wherein said drying band is constructed into a loop shape; and a dehydrator for removing water condensed within said drying band is provided over a path along which said drying band rotates.

9. The continuous drying apparatus for a porous web as set forth in claim 4, further comprising a conveyor roll for conveying said cooling surface element;

wherein a slippage preventing process is performed on a surface of said conveyor roll.

10. The continuous drying apparatus for a porous web as set forth in claim 9, wherein a groove is formed in the surface of said conveyor roll as said slippage preventing process.

11. The continuous drying apparatus for a porous web as set forth in claim 1, wherein a plurality of heating-medium flow passages are provided near an interior surface of said heating cylinder.

12. The continuous drying apparatus for a porous web as set forth in claim 1, wherein an induction heating coil is provided near an exterior surface of said heating cylinder.

13. The continuous drying apparatus for a porous web as set forth in claim 1, further comprising a plurality of said pressure rotating bodies disposed at different locations around and near the circumferential surface of said heating cylinder.

14. The continuous drying apparatus for a porous web as set forth in claim 13, wherein said plurality of said pressure rotating bodies are spaced at equal intervals around and near the circumferential surface of said heating cylinder.

* * * * *